United States Patent [19]

Hamill, Jr. et al.

[11] 4,398,588

[45] Aug. 16, 1983

[54] METHOD OF MAKING A RIM-STABILIZED STEEL INGOT

[75] Inventors: Paul E. Hamill, Jr., Penn Township, Westmoreland County; Robert H. Kachik, Washington Township, Westmoreland County, both of Pa.

[73] Assignee: United States Steel Corporation, Pittsburgh, Pa.

[21] Appl. No.: 230,191

[22] Filed: Feb. 2, 1981

[51] Int. Cl.[3] ..... B22D 7/00; B22D 7/10

[52] U.S. Cl. ..... 164/53; 164/56.1; 164/123

[58] Field of Search ..... 164/53, 123, 122, 56.1, 164/55.1, 57.1, 58.1, DIG. 12, DIG. 6

[56] References Cited

U.S. PATENT DOCUMENTS

| | | | |
|---|---|---|---|
| 3,025,153 | 3/1962 | Cross | 164/53 X |
| 3,414,042 | 12/1968 | Behrens et al. | 164/57.1 |
| 3,713,852 | 1/1973 | Wiley | 164/53 X |
| 3,865,643 | 2/1975 | Bales, Jr. et al. | 164/56.1 X |

*Primary Examiner*—Kuang Y. Lin

*Attorney, Agent, or Firm*—Forest C. Sexton

[57] ABSTRACT

A simple method of producing a rim-stabilized steel ingot without requiring the use of special equipment wherein a rimming-type steel is teemed into an ingot mold and thereafter allowed to rim for a suitable period of time, and then adding a particulate mixture of aluminum and an exothermic material to the top of the molten metal so that the exothermic mixture will ignite, melting and superheating the aluminum content which is driven into the molten steel at the ingot core.

5 Claims, No Drawings

METHOD OF MAKING A RIM-STABILIZED STEEL INGOT

BACKGROUND OF THE INVENTION

It is well known that sheet steels are usually produced from either rimmed steel ingots or SK steel ingots i.e., special killed steel, killed (deoxidized) with aluminum. Rimmed steel is used in applications where surface quality is the most important requirement and little or no drawability is necessary, whereas SK steel must be used where deep drawability is essential.

More recently, a so-called "rim-stabilized" steel has been developed which incorporates the desired features of both rimmed and SK steels. That is, a rim-stabilized steel ingot has a clean, good surface quality rim approaching that of a conventional rimmed steel and a low porosity core which, when rolled to sheet product, will yield good deep drawing characteristics approaching those of SK steel.

Rim-stabilized steels are presently produced by casting a rimming type steel (i.e., non-deoxidized) into an ingot mold and allowing the steel to rim for a predetermined time thereby forming a good surface quality rim. After rimming, aluminum is added to the unsolidified steel in the ingot mold to stop the rimming action and produce a low porosity SK steel within the rimmed shell.

Although rim-stabilized steels do indeed fulfill a long-felt need for a sheet steel having good surface qualities as well as deep drawability, so many problems are encountered in producing ingots thereof that the steel's properties are not as good as could be hoped for. For example, the time available for adding, melting and distributing the aluminum in an already cast ingot is quite short when considering the rather large amount of aluminum that must be added, e.g., about 2 lb. per ton. Most frequently, therefore, the aluminum is not uniformly distributed within the molten portion of the steel, especially in the lower portion thereof. This results, of course, in non-uniform deep drawing qualities.

Another problem encountered in producing rim-stabilized steel results from the inability to produce a rim which is thick enough to allow removal of all surface imperfections without exposing the non-metallic inclusions in the SK steel therebeneath. Generally, the rim is so thin that only a fast hot-scarfing operation on the rolling mill and a minimal amount of hand grinding is permitted.

Still another problem results from the practice of interrupted teeming to allow the limited rimming action. Inherent in this interruption, usually about 2 minutes, is the build-up of iron oxide scum on the exposed upper surface of the metal which increases with increased rimming time. When aluminum pellets are subsequently added on top of this surface scum, an excessive amount of refractory alumina is formed. Much of this alumina may become entrapped in the steel upon solidification. This alumina problem usually becomes even more aggravated because some of the added aluminum may not be quickly melted nor easily driven below the meniscus of the molten metal. Hence, some of the aluminum may remain on the surface of the melt to be oxidized by air, thereby producing additional quantities of the troublesome alumina. It follows, therefore, that because of the excessive amount of alumina formed, the efficiency of the operation suffers, necessitating the addition of a substantially greater amount of aluminum that is actually necessary to suitably deoxidize the cast steel.

U.S. Pat. Nos. 3,754,591 and 3,865,643 disclose an improved process for producing a rim-stabilized steel ingot which overcomes many of the above problems. The crux of the disclosed process resides in the use of molten aluminum to kill or deoxidize the molten steel core. Specifically, the process involves teeming a non-deoxidized rimming-type steel into an ingot mold to a level about 80 to 95% full. Teeming is then interrupted to allow a rimming action in the mold to progress for a period of from ½ to 15 minutes. Thereafter, teeming is again continued until the mold is full. During this final teeming step following the rimming action, sufficient molten aluminum is injected into the teem stream to kill or semi-kill the molten core. Because the aluminum is already molten when it is added to the teem stream, it is more uniformly distributed throughout the core, and with a minimum formation of surface alumina.

Although the above patented process has achieved a considerable degree of commercial success, by virtue of its superior product, the process itself, however, presents a noted disadvantage in that it requires the use of specialized equipment and a trained operator. Specifically, the specialized equipment must include a furnace or crucible to melt and contain the aluminum, a pump to deliver a predetermined quantity of molten aluminum through a refractory-lined delivery pipe and, of course, an energy source to melt the aluminum. All such pumps in commercial use today are fixed-volume, pressure pumps so that it is not possible to accurately vary the amount of molten aluminum added without going to a different pump size. In addition, the equipment must be mobile so that it can follow the ladle during the teeming of a drag of ingot molds. Because of the reaction nature of molten aluminum, the equipment is somewhat difficult to maintain in a good operable condition. The safe and effective operation of the equipment requires the services of a trained operator.

SUMMARY OF THE INVENTION

This invention is predicated upon our development of simplified method of making rim-stabilized steel ingots without the need for any specialized equipment or trained operator, which may merely involve the hand-addition of a prepackaged exothermic-aluminum mixture to the top of the fully teemed ingot. In addition, this process provides an excellent means by which to add other alloy additives, such as columbium, vanadium and other high-melting point materials and alloys. Pursuant to some embodiments of this inventive process, back-teeming after the rimming action may be eliminated.

A primary object of this invention, therefore, is to provide a simplified method of producing rim-stabilized steel ingots which do not require any special equipment or trained operators and do not require any back-teeming after the rimming action.

Another object of this invention is to provide a new and simple method for making of molten addition to liquid steel.

These and other objects and advantages of this invention will become apparent from the following detailed description.

DESCRIPTION OF THE PREFERRED EMBODIMENT

According to the preferred practice of this invention, a molten rimming-type steel is teemed into an ingot mold at a normal rate. Unlike prior art processes for making rim-stabilized steel ingots, it is not necessary pursuant to this process to interrupt teeming before the mold is full. Accordingly, the ingot molds may be teemed to the top of the mold pursuant to conventional rimming steel teeming practices. Preferably, hot top ingot molds are utilized and the ingot mold filled to the bottom of the hot top. After the ingot has been teemed, it is allowed to rim for a period of from ½ to 15 minutes, and preferably from 2 to 7 minutes depending upon the thickness desired in the rim. Thereafter, a predetermined quantity of a solid granular mixture of aluminum and an exothermic material is deposited on top of the molten metal in the ingot mold. Heat from the molten metal will cause the exothermic material to be ignited, thereby melting and superheating the aluminum content. The molten aluminum is quickly carried into the molten iron in the core of the ingot to provide a surprisingly uniform distribution of aluminum throughout the core which quickly kills the core. The resulting rim-stabilized steel will have a quality far superior to one produced pursuant to aluminum shot injection practices and comparable, if not superior, to one produced pursuant to molten aluminum injection practices.

The unexpected quickness of the steel deoxidation reaction, i.e. killing, in the above-described procedure, is believed to be due to a combination of several favorable factors. First, it is believed that the aluminothermic reaction with an excess of aluminum, forms an iron-aluminum alloy which is more dense than aluminum alone, and because of this higher density, the aluminum containing alloy more quickly settles into the molten steel core. Secondly, the heat of the aluminothermic reaction will melt the ingot surface scum therebeneath so that the scum will not then be present as a barrier to the reaction product metal. Thirdly, the aluminothermic reaction product slag phase protects the metal phase from atmospheric oxidation. And lastly, the local effervescence of the reaction itself provides sufficient surface agitation to enhance penetration of the molten metal reaction product.

As noted in the above procedure, back-filling, i.e. further teeming following the aluminum addition, is not necessary to achieve good result. Nevertheless, to guarantee a good uniform aluminum distribution throughout the ingot core, we have preferred to utilize an interrupted teeming procedure. That is to say, teem the ingot mold to a level of about 90 to 95% full, then after a suitable rimming time, add the aluminum-exothermic material mixture and finally back-fill the ingot with molten steel to a full level.

The aluminum, exothermic material mixture should preferably be an aluminum-rich aluminothermic blend having iron oxide as the oxidizing agent. Ideally, it should be a ternary mixture of powdered iron ore and powdered aluminum in stoichiometric proportions, as the oxidant and fuel for the exothermic reaction, and solid aluminum shot as the source of aluminum to kill and alloy the ingot core. To exemplify, we have preferred to use a mixture consisting of three parts of a standard aluminothermic material and one part ½-inch aluminum shot. The standard aluminothermic material consists of 75% hematite ore (95% $Fe_2O_3$—5% $SiO_2$) at −6 mesh, and 25%—100 mesh aluminum powder. While the 3:1 ratio of ATR mixture to shot was ideal, ratios as low as 1.5:1 and 1:1 would be workable. Obviously, ratios higher than 3:1 would be workable, but would increase cost without appreciable benefit. The particle sizes of the aluminothermic mix constituents is not critical, as any size within the range −10 to −200 mesh should be workable.

In addition to the above trinary mixture, other alloy additives may be provided if desired to adjust the chemistry of the steel ingot. For example, columbium, vanadium, titanium and other high melting point alloy constituents can be added to the ingot metal by providing sources thereof to the aluminum-exothermic material mixture. The only restriction in this regard is that the added alloy constituent be less reactive than aluminum so that the alloy addition does not itself oxidize and collect in the slag. Pursuant to this practice, high strength-low alloy rim stabilized steels can be readily produced.

To facilitate the addition of the aluminum-exothermic material mixture, it is preferred that the constituents, well blended, be prepackaged in paper, cardboard, aluminum foil or some other such material which will quickly burn away or melt. The total quantity of material added will of course depend upon the size of the ingot mold and the steel chemistry. To simplify the operation so that it can be implemented by common laborers, we have preferred to prepackage the mixture all in four-pound packages. Actual trials have shown that the four-pound packages are convenient to handle and can be thrown onto the ingot steel surface without splashing, contrary to much larger packages. In addition, the number of packages added can easily be varied to vary the amount of aluminum to be added.

Since one of the aluminothermic reaction products is a high-alumina slag phase, it is somewhat surprising that the insoluble aluminum content in the ingot core is not intolerably high. As shown in Table I, ingots produced pursuant to this practice have a surprisingly low insoluble aluminum content through the ingot, significantly lower than ingots produced with solid aluminum addition. We suspect it to be due, at least in part, by the fact that the aluminothermic slag phase is superheated as it enters the molten ingot core, and thus readily floats back to the surface. In addition, the much cooler overlaying slag phase, or scum, on the surface of the ingot metal prior to the aluminothermic reaction is melted and superheated so that it too readily re-floats to the ingot surface.

To exemplify the distribution and recovery of aluminum in this process, a 500-pound heat of steel, containing 0.07% C, 0.35% Mn, 0.010% P, 0.020% S and 0.22% Si, was cast into an 8×8×27 inch refractory mold containing a porous plug in the bottom of the mold. Prior to pouring the liquid steel into the mold, a flow of 0.12 cfm argon through the porous plug was established, and this flow was maintained for two minutes after the heat was poured (simulated rimming action). At this time, an aluminum-aluminothermic charge package, consisting of a uniformly blended mixture of 1.125 pound of hematite iron ore (oxidizer), 0.375 pound of 100-mesh aluminum powder (fuel), and 0.5 pound of aluminum shot (solid aluminum addition—2.0 pounds/ton) which had been wrapped in a sheet of aluminum foil, was dropped onto the surface of the steel bath. The ATR reaction mixture ignited almost instantly and burned completely in about twelve seconds. After bubbling argon for about ten additional seconds, the gas flow was stopped and the ingot allowed to solidify. Two additional control ingots were prepared in a similar manner except that solid shot alone was added to one heat and molten aluminum was added to the other heat. All three ingots were then hot-rolled to 2-inch-thick plate. After removing a 10% top discard and a 5% bottom discard, mid-width samples from the top, mid-length, and bottom of each plate were submitted for chemical analysis. The results of the chemical analysis are presented in Table I below.

TABLE I

Aluminum Distribution in Three Ingots Treated By Different Aluminum Addition Methods

| Nominal | | Al Content, % | | | | | |
|---|---|---|---|---|---|---|---|
| | | Top | | Middle | | Bottom | |
| % Al | Type | Sol. | Insol. | Sol. | Insol. | Sol. | Insol. |
| 0.10 | ATR* | 0.082 | 0.013 | 0.080 | 0.008 | 0.075 | 0.010 |
| 0.075 | Liquid | 0.061 | 0.007 | 0.066 | 0.008 | 0.062 | 0.020 |
| 0.10 | Shot | 0.130 | 0.023 | 0.083 | 0.018 | 0.083 | 0.048 |

*Aluminothermic Reaction per this inventive process.

As shown in Table I, a more uniform aluminum distribution was obtained with the aluminum-aluminothermic mixture and liquid-aluminum additions than was obtained with the shot-aluminum addition. It should be noted that the insoluble aluminum contents of the samples which had been treated with aluminum-aluminothermic mixture and with liquid aluminum were lower and less variable than the insoluble aluminum content of the shot-treated sample, indicating that these methods introduce less non-metallics into the bath.

In a subsequent inclusion study performed on an actual steel ingot produced in accordance with this inventive process, and another ingot produced with direct molten aluminum addition pursuant to U.S. Pat. No. 3,754,591 showed that the average inclusion content of both ingots was about the same at approximately 0.18 volume percent. There were differences, however, in that the ingot produced pursuant to this process contained fewer but larger inclusions. This verified that virtually none of the exothermic reaction slag product was carried into the ingot metal.

The following description of a commercial-sized trial should better illustrate the characteristics of this invention. At commercial facilities, where commercial rim-stabilized steel ingots were being produced pursuant to the process as claimed in U.S. Pat. No. 3,754,591 with molten aluminum injection, one test ingot was produced in accordance with this invention. Like the other ingots, the test ingot was produced by teeming the mold to a level about 90% full, and then allowing the metal to rim for 1¾ minutes. Instead of injecting aluminum during the back-pour, however, the test ingot was produced by tossing 22 four-pound packages of aluminum exothermic mixture onto the metal in the ingot mold over a period of about 12 seconds, and then back-pouring the mold to the full level. The mixture in each package consisted of one-pound aluminum shot, 2.25 pounds of the hematite iron ore (−6 mesh), and 0.75 pounds of powdered aluminum (−100 mesh). A hot-rolled coil from the test ingot was compared to a coil from a commercial ingot. The tables below show how the two coils compared.

TABLE II

Chemical Composition of the Hot-Rolled Sheet Samples from the MA-RK and ATR Steels, percent

| Ingot Practice | Coil Number | Location* | C | Mn | P | S | Si | Al Sol | Al Total | N |
|---|---|---|---|---|---|---|---|---|---|---|
| MA-RK Process | 549657 | Head $QW_1$ | | | | | | 0.042 | 0.052 | |
| | | ¼ Length $QW_1$ | | | | | | 0.042 | 0.052 | |
| | | Center $QW_1$ | 0.066 | 0.31 | 0.009 | 0.023 | <0.003 | 0.042 | 0.051 | 0.003 |
| | | Center $QW_2$ | | | | | | 0.044 | 0.054 | |
| | | ¾ Length $QW_1$ | | | | | | 0.041 | 0.051 | |
| | | Tail $QW_1$ | | | | | | 0.044 | 0.058 | |
| ATR | 549656 | Head $QW_1$ | | | | | | 0.017 | 0.031 | |
| | | ¼ Length $QW_1$ | | | | | | 0.017 | 0.026 | |
| | | Center $QW_1$ | 0.070 | 0.33 | 0.009 | 0.023 | 0.004 | 0.018 | 0.026 | 0.003 |
| | | Center $QW_2$ | | | | | | 0.020 | 0.032 | |
| | | ¾ Length $QW_1$ | | | | | | 0.019 | 0.030 | |
| | | Tail $QW_1$ | | | | | | 0.020 | 0.030 | |

*QW denotes quarterwidth.

TABLE III

Oxygen and Microcleanliness Results of the Hot-Rolled Sheet Samples From the MA-RK and ATR Steels

| Ingot Practice | Coil No. and Location | | Oxygen, ppm | QTM Ratings+ Average Inclusion Area, % | Worst-Field Area, % | No. of Fields ≧0.5% | Length Factor* (100 Fields) |
|---|---|---|---|---|---|---|---|
| MA-RK | 549657 | Head | 139 | 0.19 | 1.15 | 3 | 80.4** |
| | | ¼ Length | 105 | 0.17 | 1.20 | 2 | 147.8** |
| | | Center | 117 | 0.16 | 0.80 | 0 | 5.1 |
| | | ¾ Length | 130 | 0.17 | 1.50 | 2 | 147.2** |
| | | Tail | 159 | 0.20 | 1.35 | 4 | 336.0** |
| | | Average | 130 | 0.18 | 1.20 | 3 | 143.3 |
| ATR | 549656 | Head | 135 | 0.19 | 1.80 | 1 | 1.0 |
| | | ¼ Length | 103 | 0.19 | 3.00 | 1 | 3.2 |
| | | Center | 118 | 0.18 | 1.20 | 2 | 0.5 |
| | | ¾ Length | 114 | 0.16 | 1.70 | 1 | 1.8 |
| | | Tail | 104 | 0.16 | 0.73 | 1 | 0 |

TABLE III-continued

| Ingot Practice | Coil No. and Location | Oxygen, ppm | QTM Ratings+ Average Inclusion Area, % | Worst-Field Area, % | No. of Fields ≧0.5% | Length Factor* (100 Fields) |
|---|---|---|---|---|---|---|
| | Average | 115 | 0.18 | 1.69 | 1 | 1.6 |

Oxygen and Microcleanliness Results of the Hot-Rolled Sheet Samples From the MA-RK and ATR Steels +Average cleanliness determinations of samples from the edge, rim-killed interface, quarterwidth, midwidth, and ¾-width locations.

$$\text{*Length Factor (100 Fields)} = 2\left[\frac{\text{Sum of lengths of all inclusions in 50 fields equal to or larger than 125 microns}}{\text{125 microns}}\right]$$

**Some of the samples from these locations contained fine, discontinuous, alumina inclusions strung out in long bands along the length of the specimens.

As shown in Table II, the soluble aluminum content was lower in the trial ingot as compared to the commercial ingot, but was, nevertheless, still within the specification range for drawing-quality aluminum-killed (DQAK) steel. The inclusion study shown in Table III showed that both ingots contained about the same volume percent inclusion, i.e. about 0.18 vol. %. The test ingot, however, contained fewer but larger inclusions, as already noted. Otherwise, the products from the two ingots were virtually identical.

We claim:

1. A process for producing a rim-stabilized steel ingot comprising:
   (a) teeming a rimming-type steel into an ingot mold until said mold is substantially full,
   (b) allowing the teemed steel to rim in the ingot mold for a period of from ½ to 15 minutes,
   (c) thereafter adding an aluminum-exothermic material mixture to the top of the molten metal in the ingot mold, said mixture containing sufficient particulate aluminum as will at least semi-kill the molten steel in the ingot core and a stoichiometric blend of fuel and oxidizing agent sufficient to melt and superheat the particulate aluminum,
   (d) and allowing the heat from the molten steel in the ingot mold to ignite the exothermic mixture so that the exothermic reaction will (1) melt and superheat the particulate aluminum, (2) melt any ingot surface scum therebeneath, and (3) drive the molten, superheated aluminum into the ingot core.

2. A process according to claim 1 in which said aluminum-exothermic material mixture consists of a stoichiometric blend of powdered aluminum and powdered iron oxide and sufficient excess aluminum to at least semi-kill the molten steel.

3. A process according to claim 2 in which said stoichiometric blend and said excess aluminum are admixed at a ratio of from 1:1 to 3:1.

4. A process according to claims 2 or 3 in which said excess aluminum is aluminum shot.

5. A process according to claim 1 in which said ingot mold is initially teemed to a level 90 to 95% full, and subsequently back-filled after the aluminum-exothermic material mixture is added.

* * * * *